US010375985B2

(12) United States Patent
McFarlane et al.

(10) Patent No.: US 10,375,985 B2
(45) Date of Patent: Aug. 13, 2019

(54) METHOD FOR PREPARING A TOBACCO COMPOSITION

(71) Applicant: JT International S.A., Geneva (CH)

(72) Inventors: Mary McFarlane, Limavady County Londonderry (GB); Maria Ågren, Vårgårda (SE)

(73) Assignee: JT International S.A. (CH)

( * ) Notice: Subject to any disclaimer, the term of this patent is extended or adjusted under 35 U.S.C. 154(b) by 90 days.

(21) Appl. No.: 15/362,172

(22) Filed: Nov. 28, 2016

(65) Prior Publication Data

US 2017/0150751 A1 Jun. 1, 2017

(30) Foreign Application Priority Data

Nov. 27, 2015 (EP) ..... 15196664

(51) Int. Cl.

| | |
|---|---|
| ***A24B 3/10*** | (2006.01) |
| ***A24B 3/12*** | (2006.01) |
| ***A24B 9/00*** | (2006.01) |
| ***A24B 13/00*** | (2006.01) |
| ***A24B 15/28*** | (2006.01) |

(52) U.S. Cl.

CPC ..... *A24B 15/287* (2013.01); *A24B 3/10* (2013.01); *A24B 3/12* (2013.01); *A24B 9/00* (2013.01); *A24B 13/00* (2013.01)

(58) Field of Classification Search

None

See application file for complete search history.

(56) References Cited

U.S. PATENT DOCUMENTS

| | | | | |
|---|---|---|---|---|
| 4,874,000 | A * | 10/1989 | Tamol | A24B 3/14 131/294 |
| 2013/0074856 | A1 | 3/2013 | Holton, Jr. | |
| 2015/0075543 | A1* | 3/2015 | Sjogren | A24B 15/303 131/300 |

FOREIGN PATENT DOCUMENTS

| | | |
|---|---|---|
| EP | 2 649 888 A1 | 10/2013 |
| WO | WO 2014/166845 A1 | 10/2014 |
| WO | WO 2015/063174 A1 | 5/2015 |

* cited by examiner

*Primary Examiner* — Phu H Nguyen

(74) *Attorney, Agent, or Firm* — Lerner, David, Littenberg, Krumholz & Mentlik, LLP

(57) ABSTRACT

The present invention relates to an improved method for preparing a tobacco composition suitable for use as a smokeless tobacco composition wherein the tobacco material can be cooled down, after being heated to a temperature of 80° C. or more, to a temperature of below 25° C. during a time period of 20 min or less.

15 Claims, 1 Drawing Sheet

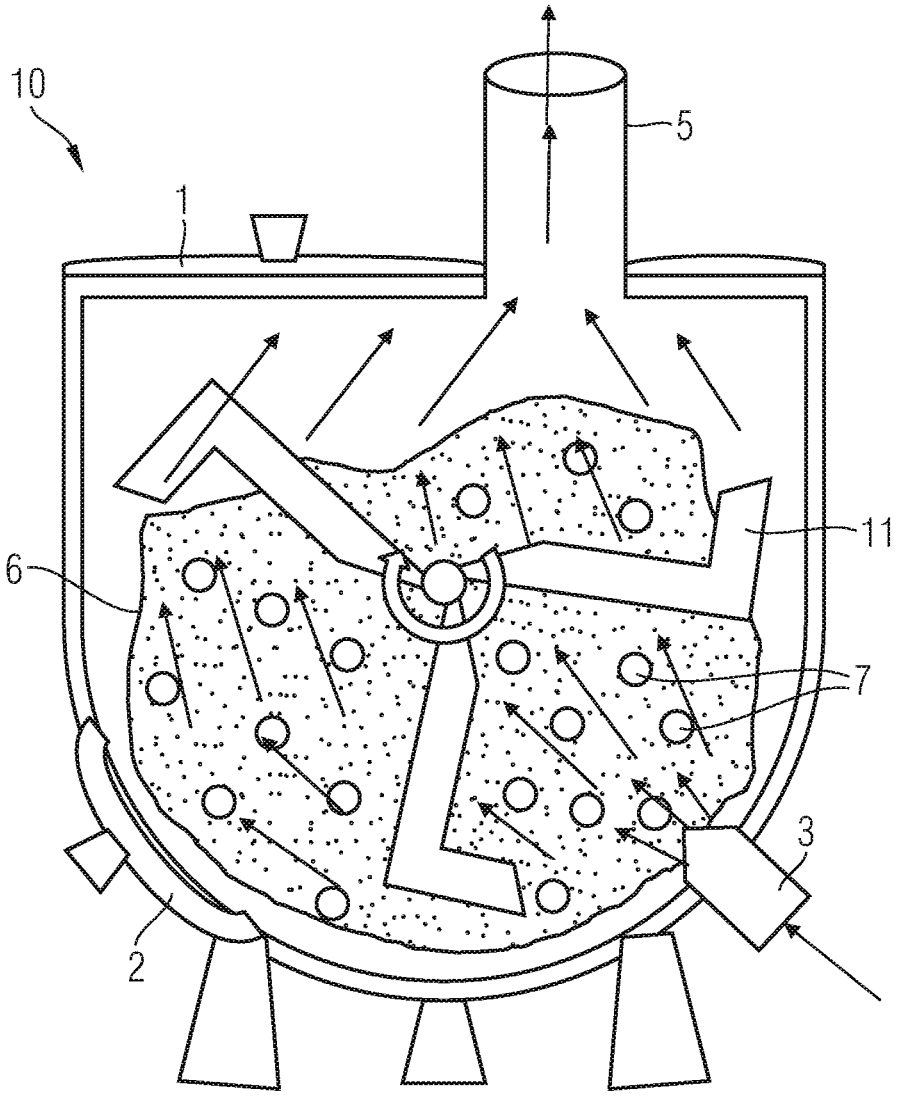
10
5
1
11
6
7
3
2

METHOD FOR PREPARING A TOBACCO COMPOSITION

CROSS REFERENCE TO RELATED APPLICATION(S)

The present U.S. patent application claims priority to European Patent Application No. 15196664.5, filed Nov. 27, 2015, the disclosure of which is incorporated herein by reference in its entirety.

TECHNICAL FIELD

The present invention relates to an improved method for preparing a tobacco composition suitable for use as a smokeless tobacco composition, to a tobacco composition obtainable by said method, and to a smokeless tobacco product comprising said tobacco composition.

BACKGROUND

Smokeless tobacco is tobacco or a tobacco product that is used by means other than smoking. These uses include chewing, sniffing, placing the product between the teeth and gum, or application to the skin.

Smokeless tobacco products are recently gaining popularity and they are available in a variety of ways including dipping tobacco, chewing tobacco, snuff or snus.

Snus is a moist powder tobacco product sold in different ways including loose snus and portion snus. Loose snus is a moist powder which can be portioned and packed into a cylindrical or spherical shape with the fingertips or a purpose-made cylindrical device. Portion snus is prepackaged moist powder in small teabag-like pouch.

The manufacture of smokeless tobacco compositions like snus is done using a batch process including a heating step wherein the tobacco material is heated to a temperature of 80° C. or more. Each batch cannot be completed until it has cooled enough for addition of further additives. The cooling takes about 8 hours to cool the tobacco material from a temperature of 70° C. or more down to a temperature about 25° C. This leads to bottlenecks in the production process.

Therefore, there is a need to provide an improved method for preparing tobacco compositions avoiding these bottlenecks.

SUMMARY

The inventors found that the disadvantages of the prior art processes can be overcome by a method for preparing a tobacco composition wherein a cryogenic fluid is applied to a vessel containing the tobacco material to cool down the temperature of the tobacco material to a temperature of below 25° C. during a time period of 20 min or less.

They further found out that the tobacco material obtained by the method of the present invention leads to a tobacco material with improved pH stability in shelf life testing.

Thus, a first aspect of the invention provides a method for preparing a tobacco composition suitable for use as a smokeless tobacco composition, comprising the following steps:

(a) providing a tobacco material in a vessel;

(b) heating the tobacco material to a temperature of 80° C. or more;

(c) introducing a cryogenic fluid through a first opening of the vessel to cool down the temperature of the tobacco material to a temperature of below 25° C. during a time period of 20 min or less.

According to another aspect, the present invention relates to a tobacco composition obtainable by the method according to the first aspect of the present invention.

According to a further aspect, the present invention relates to the use of the tobacco composition of the present invention for a smokeless tobacco product.

According to a further aspect, the present invention relates to a smokeless tobacco product comprising the tobacco composition of the present invention.

According to a further aspect, the present invention relates to a portioned smokeless tobacco product comprising the tobacco composition of the present invention.

Further preferred and exemplary embodiments of the invention are indicated in the dependent claims and the following detailed description, which, however, do not restrict the scope of the invention and only help to understand and explain the features of the present invention. Deviations and modifications on these particular features, particular in regard to other aspects of the invention, can be made without departing from the scope of the invention.

BRIEF DESCRIPTION OF THE FIGURES

FIG. 1 illustrates a blender suitable for preparing a tobacco composition of the present invention.

DETAILED DESCRIPTION

All ranges disclosed herein are to be considered to be supplemented by the term "about", unless clearly defined to the contrary or otherwise clear from the context.

All numbers or percentages relating to amounts of a substance within this application are given in wt..%, unless clearly defined to the contrary or otherwise clear from the context.

The term "smokeless tobacco composition" includes snus, American snuff, tobacco-based gums/tablets/strips, and nasal snuff as well as inhaled tobacco products that are not burnt.

The pH values given herein have been measured using CORESTA recommended method No. 69 for determination of pH of smokeless tobacco products dated June 2010.

The moisture content given herein was measured using CORESTA recommended method No. 76 for determination of moisture content (oven volatiles) of smokeless tobacco products dated April 2014.

In the following the term "tobacco material" relates to the tobacco as such. If water or salt is added to the tobacco material then "tobacco material" relates to the tobacco including said salt and/or water.

Method for Preparing a Tobacco Composition

The invention relates to a method for preparing a tobacco composition. The tobacco composition is suitable for use as a smokeless tobacco composition. The method comprises the following steps:

(a) providing a tobacco material in a vessel;

(b) heating the tobacco material to a temperature of 80° C. or more;

(c) introducing a cryogenic fluid through a first opening of the vessel to cool down the temperature of the tobacco material to a temperature of below 25° C. during a time period of 20 min or less.

Step (a)

The tobacco material is provided in a vessel. As vessel any suitable vessel can be used like a blender or mixer. Optionally the vessel can be heated using a heating device.

As tobacco material any tobacco can be used. Examples thereof include a mixture of stem and lamina derived from various sources and curing types, but also just stems or just lamina or just shredded leaves or shredded ground tobacco/ botanical plant material, mixtures thereof, etc. can be used for production of the smokeless tobacco material.

The pH value of the raw tobacco material depends on the used tobacco but is typically in the range of about pH 5.0-6.5.

Step (b)

After introducing the tobacco material into the vessel, the tobacco material is heated to a temperature of 80° C. or more, preferably to a temperature between 80° C. and 110° C., . The temperature is kept about 0.5 to 5 hours, preferably about 1 to 3 hours, more preferably about 2.0 hours.

The heating can be performed by heating the vessel using a heating device, for example a jacket heating, optionally, a fluid, for example steam, is used to heat the vessel, preferably the vessel is heated to achieve a wall temperature inside the vessel of about 80-110° C., preferably about 90-105° C., more preferably about 100° C. It is also possible to heat the tobacco material by introducing a fluid into the vessel having at least a temperature in the range of the temperature which should be achieved for the tobacco after heating.

In one embodiment the heat-treatment can be performed by heating the vessel using the heating device and by simultaneously, or consecutively, either before or afterwards introducing the fluid into the vessel to heat the tobacco material.

The pH value of the tobacco material after heating is preferably the same as before the heating, however the pH of the tobacco material might be lowered during the heating by pH 0.1-2, preferably 0.1-1, more preferably 0.1-0.5.

Step (c)

Following step (b) a cryogenic fluid is introduced through a first opening of the vessel to cool down the temperature of the tobacco material to a temperature of below 25° C. during a time period of 20 min or less.

Preferably 0.01 -10 kg cryogenic liquid are used per kg tobacco material to cool down the temperature of the tobacco material from 80° C. to 20° C. More preferably 0.03 -5 kg, even more preferably 0.05 -2.5 kg, in particular even more preferably 0.075 -1 kg, most preferably 0.1 -0.8 kg, even most preferably 0.2 -0.6 kg, in particular even most preferably 0.3 -0.5 kg cryogenic liquid are used per kg tobacco material.

When portion tobacco is produced preferably 0.3 kg cryogenic liquid are used per kg tobacco material to cool down the temperature of the tobacco material from 80° C. to 20° C.

When loose tobacco is produced preferably 0.5 kg cryogenic liquid are used per kg tobacco material to cool down the temperature of the tobacco material from 80° C. to 20° C.

Preferably the cryogenic fluid is introduced through a first opening of the vessel at a flow rate of 0.01 or more kg fluid/min/kg tobacco material. By introducing the cryogenic fluid with a flow rate of 0.01 or more kg fluid/min/kg tobacco material it is possible to cool down the temperature of the tobacco material to a temperature of below 25° C. during a time period of 20 min or less. More preferably the flow rate is 0.01 to 10 kg fluid/min/kg tobacco material, even more preferably 0.01 to 1 kg, most preferably 0.02-0.5, even most preferably 0.03-0.3, in particular most preferably 0.03-0.1, and even in particular most preferably 0.03-0.1.

Preferably the tobacco material is cooled down to a temperature of below 25° C. during a time period of 14 min or less, more preferably 10 min or less, even more preferably 8 min or less, most preferably 6 min or less, in particular preferably 5 min or less, in particular most preferably 3 min or less.

As cryogenic fluid any cryogenic fluid can be used, preferably a liquid cryogenic gas like carbon dioxide ($CO_2$), nitrogen ($N_2$), or nobel gases like helium (He), neon (Ne), argon (Ar), krypton (Kr), or xenon (Xe). More preferably an inert, non-reactive gas like nitrogen ($N_2$), or noble gases are used. Most preferably liquid nitrogen ($N_2$) is used as cryogenic fluid.

By using an inert, non-reactive gas it is possible to maintain the pH value of the tobacco material constant during the cooling step and the tobacco material before the cooling step and after the cooling step has almost the same pH value.

Furthermore, by using a cryogenic fluid for cooling the tobacco material it is possible to maintain the moisture content of the tobacco material during the cooling step without impairing the organoleptic properties of the tobacco composition. Thus, the moisture content of the tobacco material before the cooling step is almost the same as the moisture content of the tobacco material after the cooling step.

The tobacco material obtained by the method of the present invention shows improved pH stability in shelf life testing. The addition of liquid nitrogen may quench natural degradation reactions in the tobacco material and thus provides a product with a more stable shelf life pH.

Preferably the cryogenic fluid is introduced in the vessel for a time period of 14 min or less, more preferably 10 min or less, even more preferably 8 min or less, most preferably 6 min or less, in particular preferably 5 min or less, in particular most preferably 3 min or less.

In one embodiment the method of the invention comprises an additional step of adding water to the tobacco material prior to the heating step (b) or during the heating step (b). Preferably the water is added in such an amount that the tobacco composition has a moisture content of about 10%-50%, preferably about 10%-40%, more preferably about 15%-35%. When producing loose tobacco the moisture content is preferably about 30-40%, more preferably about 31-35%, most preferably about 33% and when portion tobacco is produced the moisture content is preferably about 10-25%, more preferably about 11-20%, most preferably about 15%.

In a preferred embodiment the water is added to the tobacco material during the heating step (b) by introducing steam into the vessel.

By introducing steam into the vessel during the heating step (b) it is possible to heat the tobacco material using the steam and at the same time to adjust the moisture content to the desired range. Thus, the steam can be used for heating the tobacco material and adjusting the moisture content of the tobacco material.

As mentioned above by using a cryogenic fluid for cooling the tobacco material it is possible to maintain the moisture content of the tobacco material during the cooling step without impairing the organoleptic properties of the tobacco composition. Thus, preferably the moisture content of the tobacco material after cooling is the same than the moisture content of the tobacco material before cooling. Thus, the tobacco material after the cooling step has a moisture content of about 10%-50%, preferably about 10%-40%, more preferably about 15%-35%. When producing loose tobacco the moisture content is preferably about 30-40%, more preferably about 31-35%, most preferably about 33% and when portion tobacco is produced the moisture content is preferably about 10-25%, more preferably about 11-20%, most preferably about 15%.

In a preferred embodiment the tobacco material is mixed during the introduction of the cryogenic fluid in step (c). Preferably a mixer or blender is used as a vessel for performing the mixing. In a further preferred embodiment the tobacco material is mixed by the pressure of the cryogenic fluid introduced into the vessel.

In a preferred embodiment the method of the invention comprises an additional step (d) of adding additives to the tobacco material after the cooling of the tobacco material.

In a further preferred embodiment of the method of the invention, a buffer is added as pH regulator after the cooling of the tobacco material. Preferably the buffer is added in an amount to adjust the pH of the tobacco material to a value in the range of pH 7.0 to 9.0, preferably, pH 8.1-8.7, more preferably pH 8.45-8.55.

FIG. 1 illustrates a vessel (10), e.g. a mixer or blender comprising a loading hatch (1), and a dispensing hatch (2), an injection nozzle (3), a gas exhaust (5), and mixer blades (11). The vessel (10) is loaded with tobacco material (6) via the loading hatch (1). The injection nozzle (3) is used to introduce a cryogenic fluid (4) into the vessel (10) to cool the tobacco material (6). The cryogenic fluid (4) will vaporize to form a gas (7) and preferably the injection nozzle is located at the bottom of the vessel so that the cryogenic fluid (4)/the formed gas (7) pass through the tobacco material (6). The gas (7) is discharged via the gas exhaust (5). After treating the tobacco material (6) in the vessel (10) the tobacco material (6) can be discharged from the vessel (10) via the dispensing hatch (2).

Tobacco Composition

The invention further relates to a tobacco composition obtained or obtainable by the method of the present invention.

The tobacco composition of the present invention can be used for a smokeless tobacco product.

Smokeless Tobacco Product

The invention further relates to a smokeless tobacco product comprising the tobacco composition obtained by the method of the present invention. The smokeless tobacco product can be a loose or a portioned smokeless tobacco product.

Portioned Smokeless Tobacco Product

The invention further relates to a portioned smokeless tobacco product comprising the tobacco composition of the present invention. In the portioned smokeless tobacco product the tobacco composition is wrapped in a wrapping material to make a teabag-like pouch. The portioned smokeless tobacco product of the present invention may be manufactured by known methods, using common equipment.

EXAMPLES

The present invention will now be described with reference to examples thereof, without limiting the scope of the invention to these particular examples.

Example 1

Example 1 relates to a method for preparing a tobacco composition for a portioned smokeless tobacco product.

A tobacco blend (12% moisture content, pH 5.0) of 35.6 kg of snus portion blend was added to a blender (a 170 liter volume steam jacketed vessel). A heat treatment process was applied to the blend in the blender by steam injection for 20 minutes. The blend had a final temperature of 110° C., a moisture content of 17%, and a pH of 5.0. Afterwards the blend was heat treated in the blender, having a vessel wall temperature of 100° C. and agitated with ploughshare rotating blade periodically over 3 hours. The blend had a final temperature of 75° C., a moisture content of approximate 15%, and a pH of approximate 5.0.

Before the heat treatment or during the heat treatment, salt was added to the tobacco blend in the blender.

After the heat treatment the mixture is cooled by injecting liquid nitrogen into the hot blend in the blender. The blend had a starting temperature of 60° C., a moisture content of approximate 15%, and a pH of approximate 5.0. The total mass of the blend with the salt was 40.00 kg.

The liquid nitrogen was continuously injected into the blender with mixer blades of the blender continuously rotating and the temperature readout of mixer used to determine injection stop point.

After 3.5 min of injection and using 12 kg of liquid nitrogen (flow rate: 3.43 kg liquid nitrogen/min) a temperature of 14.4° C. was achieved and the cooled blend had a moisture content of 15%, and a pH of 5.0). The flow rate of liquid nitrogen per minute per kg of the blend was 0.086 kg/min/kg tobacco mixture.

Afterwards the blend was buffered and flavoured to obtain a final blend with a moisture content of approximate 24% and a pH of approximate 8.0.

Example 2

Example 2 relates to a method for preparing a tobacco composition for a loose smokeless tobacco product. The same blender as described in example 1 was used.

A tobacco blend (11% moisture content, pH 5.0) of 39.6 kg of loose snus blend was added to the blender. 40 liter water were added to adjust the moisture content of the tobacco blend to 31%.

A heat treatment process was applied to the blend in the blender by steam injection for 20 minutes. The blend had a final temperature of 110° C., a moisture content of 37%, and a pH of 5.0. Afterwards the blend was heat treated in the blender, having a vessel wall temperature of 100° C. and agitated with ploughshare rotating blade periodically over 3 hours.

Before the heat treatment or during the heat treatment, salt was added to the tobacco blend in the blender.

After the heat treatment the mixture is cooled by injecting liquid nitrogen into the blender. The blend had a starting temperature of 67° C., a moisture content of 33.5%, and a pH of 5.0. The total mass of the blend was 53.17 kg.

The liquid nitrogen was continuously injected into the blender with mixer blades continuously rotated and the temperature readout of mixer used to determine injection stop point.

After 4 min of injection and using 16 kg of liquid nitrogen (flow rate: 4 kg liquid nitrogen/min) a temperature of 12° C. was achieved and the cooled blend had a moisture content of 33.4%, and a pH of 5.0). The flow rate of liquid nitrogen per minute per kg blend was 0.075 kg/min/kg tobacco mixture.

Afterwards the blend was buffered and flavoured to obtain a final blend with a moisture content of 55.0% and a pH of 8.2.

The tobacco compositions obtained in Examples 1 and 2 show less undesirable organoleptic properties compared to a tobacco composition prepared according to a conventional process. Thus, the cooling process according to the present invention lowered the formation of undesirable organoleptic properties.

Examples 3-5

Examples 3-5 were carried out according to description of examples 1 and 2 using a pilot blender having a volume of 170 L (Example 3), a production blender having a volume of 2400 L (Example 4), and a production blender having a volume of 4800 L (Example 5). The parameters of the process are shown in the following table 1.

TABLE 1

| Parameters | Example 3 | | Example 4 | | Example 5 | |
|---|---|---|---|---|---|---|
| Blender volume [l] | 170 | | 2400 | | 4800 | |
| Number of injection nozzles per blender | 1 | | 4 | | 6 | |
| Amount of tobacco [kg] | 40 | | 450 | | 900 | |
| Flow rate of liquid nitrogen per injection nozzle [kg ($N_2$)/min] | 4 | | 5.7 | | 5.5 | |
| Total flow rate per blender [kg ($N_2$)/min] | 4 | | 22.8 | | 33 | |
| Flow rate kg ($N_2$)/kg (snus)/min | 0.1 | | 0.05 | | 0.037 | |
| Type of tobacco | portion | loose | portion | loose | portion | loose |
| Amount of liquid nitrogen to cool snus down from 80° C. to 20° C. [kg] | 12 | 20 | 135 | 225 | 270 | 450 |
| Application time [min] | 3 | 5 | 6 | 10 | 8 | 14 |
| Amount of liquid nitrogen per kg snus to cool snus down from 80° C. to 20° C. [kg ($N_2$)/kg (snus)] | 0.3 | 0.5 | 0.3 | 0.5 | 0.3 | 0.5 |

For cooling snus down from 80° C. to 20° C. 0.3 kg liquid nitrogen per kg snus is needed for portion snus and 0.5 kg liquid nitrogen per kg snus is needed for loose snus.

Using a total flow rate of 4 kg/min for nitrogen injection the portion snus can be cooled down from 80° C. to 20° C. in 3 minutes using a pilot blender having a volume of 170 L, and the loose snus can be cooled down in 5 minutes.

Using a total flow rate of 22.8 kg/min for nitrogen injection the portion snus can be cooled down from 80° C. to 20° C. in 6 minutes using a production blender having a volume of 2400 L, and the loose snus can be cooled down in 10 minutes.

Using a total flow rate of 33 kg/min for nitrogen injection the portion snus can be cooled down from 80° C. to 20° C. in 8 minutes using a production blender having a volume of 4800 L, and the loose snus can be cooled down in 14 minutes.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A method for preparing a tobacco composition suitable for use as a smokeless tobacco composition, comprising the following steps:

(a) providing a tobacco material in a vessel;

(b) heating the tobacco material to a temperature of 80° C. or more;

(c) cooling the tobacco material by introducing a cryogenic fluid through a first opening of the vessel so that the cryogenic fluid passes through the tobacco material to cool down the temperature of the tobacco material to a temperature of below 25° C. during a time period of 20 min or less, wherein the cryogenic fluid is a gas when introduced into the vessel, the gas being distributed throughout the tobacco material during the cooling of the tobacco material.

2. The method according to claim 1, wherein 0.01-10 kg cryogenic liquid are used per kg tobacco material.

3. The method according to claim 1, wherein the cryogenic fluid is introduced at a flow rate of 0.01 or more kg/min/kg tobacco material.

4. The method according to claim 1, comprising an additional step of adding water to the tobacco material prior to the heating step (b) or during the heating step (b).

5. The method according to claim 4, wherein the additional step of adding water to the tobacco material during the heating step (b) comprises introducing steam.

6. The method according to claim 1, comprising an additional step of adding a salt to the tobacco prior to the heating step (b) or during the heating step (b).

7. The method according to claim 1, wherein the tobacco material is stirred during the step (c).

8. The method according to claim 1, wherein the cryogenic fluid is introduced in the vessel for a period of 4 minutes.

9. The method according to claim 1, wherein the cryogenic fluid is liquid nitrogen or liquid carbon dioxide.

10. The method according to claim 1, comprising an additional step (d) of adding a buffer to the tobacco material to adjust the pH to a value in the range of 7.0 to 9.0.

11. The method according to claim 1, wherein the tobacco material is agitated during the introduction of the gas.

12. The method according to claim 11, wherein the tobacco material is agitated during the introduction of the gas by a pressure of the gas that is introduced into the vessel.

13. The method according to claim 11, wherein the vessel comprises mixing blades, and the tobacco material is agitated during the introduction of the gas by the mixing blades.

14. The method according to claim 1, wherein the gas is formed by vaporization of a liquid to form the gas when the cryogenic fluid is introduced into the vessel.

15. The method according to claim 1, wherein the first opening of the vessel is located at a bottom of the vessel, and the vessel has a second opening at a top of the vessel, so that the gas passes through the tobacco material as it rises from the first opening to the second opening.

* * * * *